United States Patent [19]

Fry

[11] Patent Number: 4,969,832

[45] Date of Patent: Nov. 13, 1990

[54] ROTARY COMPRESSOR ELECTRICAL GROUND DEVICE

[75] Inventor: Emanuel D. Fry, Tecumseh, Mich.

[73] Assignee: Tecumseh Products Company, Tecumseh, Mich.

[21] Appl. No.: 420,297

[22] Filed: Oct. 12, 1989

[51] Int. Cl.[5] ..... H01R 4/26; H01R 4/66

[52] U.S. Cl. ..... 439/92; 439/860

[58] Field of Search ..... 439/92, 860, 438, 439, 439/441, 95–97, 926

[56] References Cited

U.S. PATENT DOCUMENTS

| | | | |
|---|---|---|---|
| 2,471,625 | 5/1949 | Johnstone | 439/439 |
| 3,015,795 | 1/1962 | Meacham | 339/14 |
| 3,210,719 | 10/1965 | Graeff | 439/439 |
| 3,560,630 | 2/1971 | Heather | 174/51 |
| 3,663,919 | 5/1972 | Jaconette | 439/97 |
| 3,665,373 | 5/1972 | Voglesonger | 439/439 |
| 3,963,292 | 6/1976 | Smith | 339/14 |
| 4,013,870 | 3/1977 | Summers | 219/451 |
| 4,461,521 | 7/1984 | Sachs | 339/14 R |
| 4,790,772 | 12/1988 | Schulte et al. | 439/860 |
| 4,840,547 | 6/1989 | Fry | 439/892 |

FOREIGN PATENT DOCUMENTS

| | | | |
|---|---|---|---|
| 659918 | 2/1987 | Switzerland | 439/441 |
| 1536189 | 12/1978 | United Kingdom | 439/439 |

*Primary Examiner*—Gary F. Paumen

*Attorney, Agent, or Firm*—Jeffers, Hoffman & Niewyk

[57] ABSTRACT

A grounding clip for connecting an electrical grounding lead to the grounding stud of a compressor. The device includes an electrically conductive body having an aperture and a plurality of resilient ears adjacent the aperture for resiliently, frictionally engaging the stud when the sud is disposed in the aperture. The resilient ears permit axial movement of the stud through the aperture in one direction only and prevent axial movement of the stud through the aperture in the other axial direction. The device also includes an opening in which a threaded fastener is received to connect an electrical grounding lead thereby electrically connecting the grounding lead to the grounding stud and compressor housing.

12 Claims, 2 Drawing Sheets

ROTARY COMPRESSOR ELECTRICAL GROUND DEVICE

BACKGROUND OF THE INVENTION

This invention relates generally to a grounding device for a hermetic refrigeration compressor. More particularly, the invention relates to an electrical grounding device which is mounted to the protective cover stud of the completed compressor assembly.

Grounding devices are well-known in the prior art, and are used in many different environments such as hermetic compressors. In a hermetic compressor, a terminal assembly is generally welded to the compressor casing to provide a means for connecting the supply of electrical energy to the motor windings. In some markets, most notably Europe, the electrical motor is required to be grounded to the compressor housing, thus necessitating the grounding device. In the prior art, such grounding devices include a metal piece, e.g., a terminal fence or a compressor mounting bracket, that is welded onto the compressor housing as the compressor is being assembled. A screw received within a threaded hole in the metal piece permits an electrical grounding lead to be physically attached to the metal piece, thereby making an electrical connection with the compressor housing. One problem with such prior art device is that two separate product configurations and manufacturing procedures are required to assemble the compressor depending on the market to which it is to be shipped. For those compressors requiring the special grounding device, compressors assembled without such device cannot easily be converted and used in their place. Conversely, the more expensive assemblies containing the grounding device may be substituted for those assembled without the grounding device, but only at a substantial cost. The result is that two separate inventories must be maintained, i.e., with and without the special grounding device. Another problem is that welding the grounding device to the compressor housing is relatively expensive. Further, there is the possibility of the welding breaking.

It is therefore desired to provide a grounding device which can easily be attached to a completed compressor assembly so that the same basic hermetic compressor may be shipped to any market.

SUMMARY OF THE INVENTION

The present invention overcomes the disadvantages of the above-described prior art by providing an electrical grounding clip that slides over the metal stud of a completed compressor assembly, and locks in place to electrically connect it to a hermetic compressor housing. The device further includes a threaded opening for receiving a threaded fastener to attach a grounding lead. The grounding device according to the present invention is superior to prior art grounding devices in that it can be quickly and securely attached to a completed compressor assembly.

An advantage of the grounding device of the present invention is that two substantially different manufacturing procedures are not required to assemble grounded and ungrounded compressors. Instead, all such compressors may be made identically, and a grounding clip can be pushed into place in a matter of seconds. A second advantage is that the grounding device can be attached to a compressor more simply and efficiently than in the prior art. The grounding device of the present invention can be quickly, efficiently and permanently installed to the metal stud by sliding the device over the metal stud of the compressor. A further advantage of the grounding device is that inventories are reduced because the device can be attached to the compressor immediately before shipping.

The present invention, in one form thereof, comprises a grounding device to electrically connect the casing of a compressor to an electrical grounding lead. The device includes an electrically conducting body and is secured to a terminal. The body includes an aperture to receive a metal grounding stud to secure the body to the grounding stud. Located adjacent the aperture is a resilient ear that resiliently and frictionally engages the stud in the aperture. In this manner, the ear permits axial movement of the stud through the aperture in one direction and prevents axial movement of the stud through the aperture in the other axial direction.

It is an object of the present invention to provide a grounding device which can be quickly and easily attached to a completed compressor assembly.

Another object of the invention is to provide a grounding device which can be attached to a compressor immediately before shipping thereby to eliminate dual inventories.

A further object of the present invention is to provide a grounding device that will avoid the need for two separate compressor assembly procedures.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein.

The exemplifications set out here illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
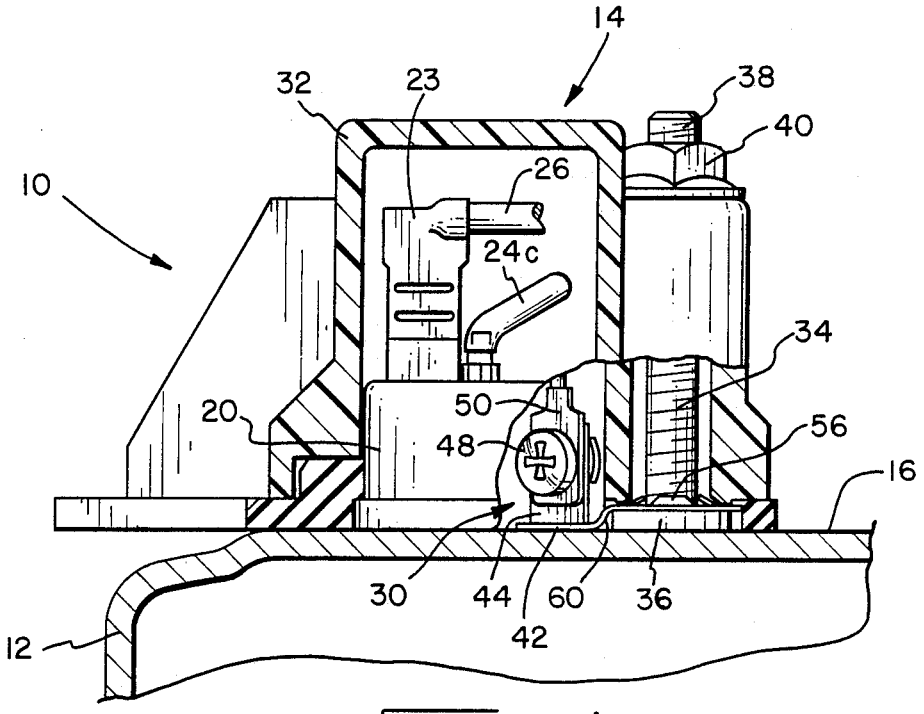
FIG. 1 is a fragmentary, sectional view of a compressor partially broken-away to illustrate a grounding device in accordance with an embodiment of the present invention.
Figure 2:
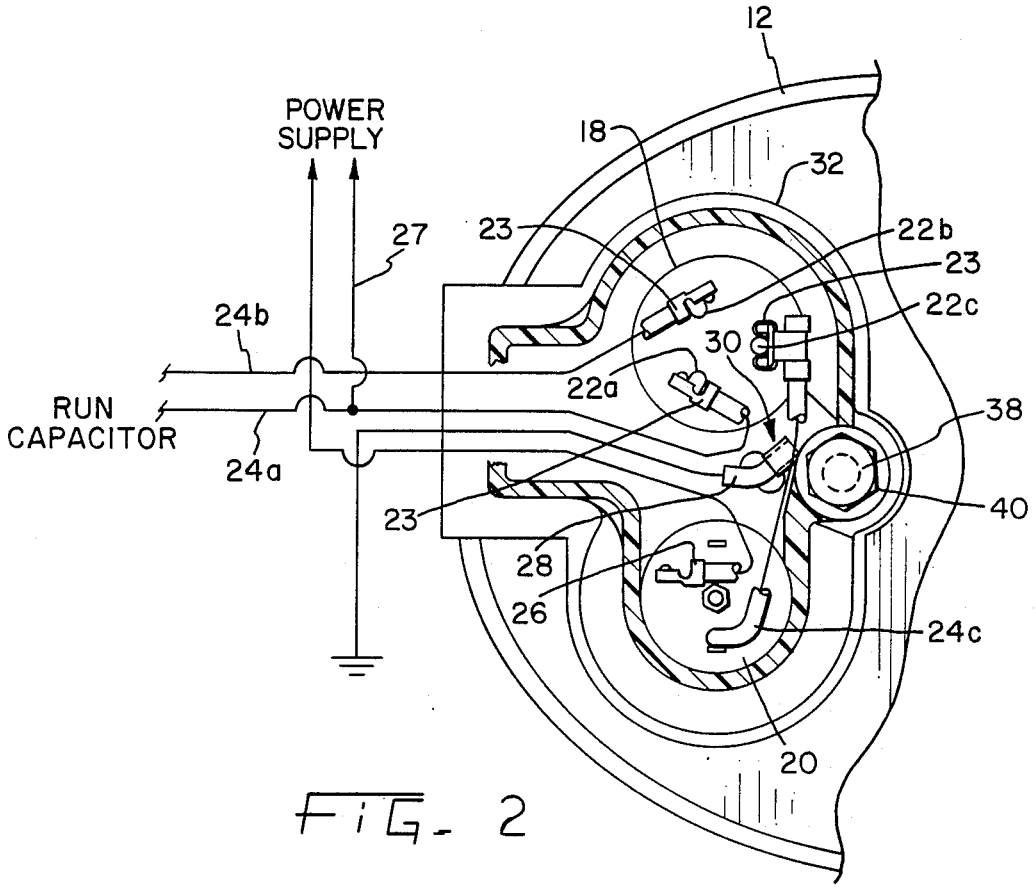
FIG. 2 is a top, partially sectional view of the compressor of FIG. 1.

Referring to FIG. 1, a typical hermetic compressor 10 is shown including a hermetically sealed outer housing 12 having an enclosed terminal assembly 14 mounted to the upper surface 16 of housing 12. Terminal cluster 18 (FIG. 2), which is welded to housing 12, comprises a plurality of terminal pins 22*a*, 22*b* and 22*c* which extend upwardly and are hermetically sealed with an epoxy or other electrically insulating material. The terminal assembly also includes an overload protector 20 which is mounted to the upper surface 16 of housing 12. Terminals 22*a* and 22*b* are connected by push-on connectors 23 and leads 24*a* and 24*b* to the run capacitor (not shown) of the electric motor. Terminal 22*c*, which is the common terminal, is connected by a wire 24*c* to one of the terminals of overload protector 20, the other terminal thereof being connected by lead 26 to the power supply. Line 27 is also connected to the power supply. Lead 28 is connected to ground and to the grounding device 30 of the present invention.

Terminal assembly 14 is enclosed by a protective cap member 32, which is made of a plastic and held in place by metallic stud 34, that is welded to compressor housing 12. Stud 34 typically includes a flange portion 36, as illustrated in FIG. 1. The upper end 38 of stud 34 is threaded so that when protective cap 32 is installed by placing the opening (not shown) in cap 32 over stud 34, nut 40 is threaded on stud 34 to hold protective cap 32 firmly in place.

Referring now to FIGS. 3–6, grounding clip 30 in accordance with the present invention will be described. Clip 30 is preferably made of spring steel having a zinc plate finish, and may have a thickness of 0.014–0.020 inch. This material is similar to that used in the Tinnerman-type clips used in a variety of applications.

Figure 3:
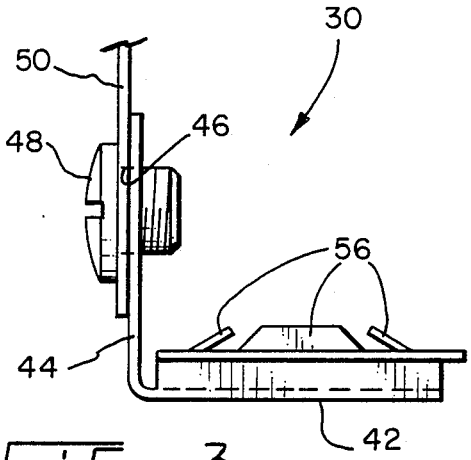
FIG. 3 is an enlarged side elevational view of the grounding device and lead of FIG. 1.
Figure 4:
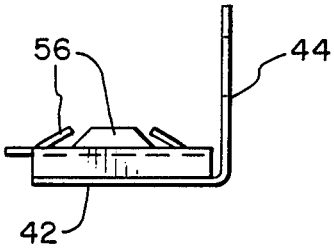
FIG. 4 is a side elevational view of the grounding device viewed from the opposite side.
Figure 5:
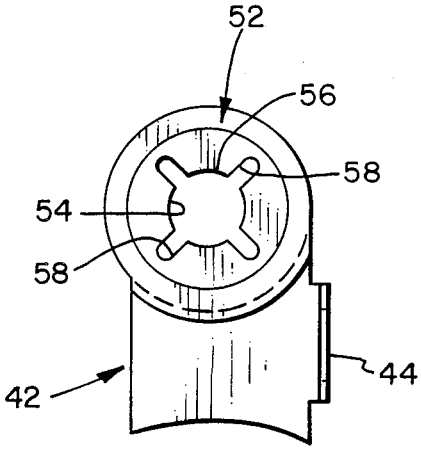
FIG. 5 is a top plan view of the grounding device.
Figure 6:
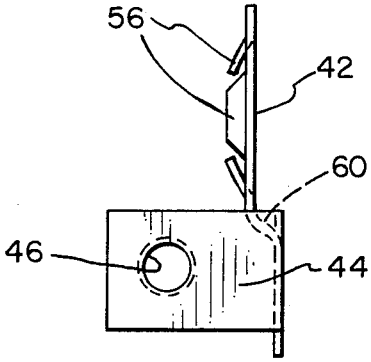
FIG. 6 is a front view of the grounding device.

Grounding clip 30 comprises a base portion 42 and an upstanding leg 44, the latter including an opening 46 adapted to engage screw 48 for the purpose of fastening slotted wire lead connector 50 in place. Leg 44 is preferably at a 90° angle relative to base 42 and is integral with base 42. Base 42 has integrally formed therein a Tinnerman-type fastener 52 comprising an opening 54 that is slightly smaller in diameter than the diameter of mounting stud 34, and a plurality of resilient ears 56 that are slightly arcuate and extend upwardly at an angle to stud 34 as illustrated in FIG. 3. Ears 56 are separated from each other by slots 58 formed in fastener portion 52. As illustrated in FIG. 6, base 42 includes a shoulder portion 60 thereby facilitating the change in elevation from the flange 36 of mounting stud 34 to the upper surface 16 of compressor housing 12, as will be described hereinafter.

To install the grounding clip 30 of the present invention, it is slid over and down mounting stud 30 to the position illustrated in FIG. 1. Due to the resilient nature of ears 56 in fastener portion 52, ears 56 will flex upwardly thereby enabling the grounding clip to be slid in place. However, because of the angle at which ears 56 engage the side of stud 34, they will frictionally grip or even cut slightly into stud 34, thereby preventing clip 30 from being pulled upwardly. Any movement to raise grounding clip 30 on stud 34 will tend to rotate ears in a downward direction to thereby cause a self-actuating locking to take place between spring ears 56 and stud 34.

As shown in FIG. 1, shoulder portion 60 is dimensioned so that base 42 will rest on the upper surface 16 of compressor housing 12, thereby further increasing the amount of electrical contact between grounding clip 30 and compressor housing 12. Electrical contact between grounding clip 30 and housing 12 is achieved due to the frictional engagement of ears 56 with mounting stud 34, which is welded to housing 12.

Regarding assembly, connector 50 can be connected to grounding clip 30 prior to the time that it is slid over mounting stud 34 or, alternatively, grounding clip 30 can be slid over stud 34 and then connector 50 fastened to it by means of screw 48.

Although the invention has been disclosed in terms of a specific embodiment as shown in the drawing figures, other configurations of the grounding clip are possible, depending on the nature of the terminal assembly for the compressor. Instead of opening 46 and screw 48, lead 50 could be attached to clip 30 by any appropriate means, such as soldering or a push-on quick connect (not shown).

While this invention has been described as having a preferred design, it will be understood that it is capable of further modification. This application is therefore intended to cover any variations, uses, or adaptations of the invention following the general principles thereof and including such departures from the present disclosure as come within known or customary practice to which this invention pertains and fall within the limits of the appended claims.

What is claimed is:

1. In a hermetic compressor for compressing fluid, including a metallic housing, an electrical terminal cluster, a protective cap member, a metallic stud connected to the metallic housing and being electrically conductive therewith, wherein the metallic stud holds the cap member in place to substantially cover the terminal cluster, and an electrical grounding lead, a grounding device for connecting the electrical grounding lead to the metallic stud, said grounding device comprising:

an electrically conductive body;

means for securing said body to the grounding lead;

means for locking said body to the metallic stud including an aperture in said body into which said stud is received, and at least one resilient ear in said aperture that resiliently and frictionally engages the metallic stud, said locking means including said ear permitting axial movement of the metallic stud through said aperture in one axial direction only and resisting axial movement of the metallic stud through said aperture in the opposite axial direction.

2. The device according to claim 1 wherein said means for securing said body to said lead comprises a threaded fastener.

3. The device according to claim 1 wherein said body is L-shaped.

4. The device according to claim 3 wherein said means for securing said body to said lead is located in a first leg of said L-shaped body and said aperture is located in a second leg of said L-shaped body.

5. The device according to claim 1 wherein said terminal cluster is welded to said housing and comprises a plurality of terminal pins which extend upwardly and are hermetically sealed.

6. The device according to claim 5 wherein the terminal cluster and said grounding device are enclosed by the protective cap member, and the metallic stud is welded to the metallic housing.

7. In a hermetic compressor for compressing a fluid, including a metallic housing, an electrical terminal cluster, a protective cap member, an electrical grounding lead, and a metallic stud connected to the metallic housing and being electrically conductive therewith, wherein the metallic stud holds the cap member in place to substantially cover the terminal cluster, a grounding device for connecting said electrical grounding lead to the metallic stud, said grounding device comprising:

an electrically conductive body;

means for connecting said body to the grounding lead; and means for locking said body to the metallic study including an aperture in said body into which the metallic stud is received, and a plurality of resilient ears in said aperture that resiliently and frictionally engage the metallic stud said locking means including said ears permitting axial movement of the metallic stud through said aperture in one axial direction only and resisting axial movement of the metallic stud through said aperture in the opposite axial direction.

8. The device according to claim 7 wherein said means for connecting said body to said lead is a threaded fastener.

9. The device according to claim 7 wherein said electrically conductive body is L-shaped.

10. The device according to claim 9 wherein said means for connecting said body to said lead is located in a first leg of said L-shaped body and said aperture and said plurality of ears are located in a second leg of said L-shaped body.

11. The device according to claim 7 wherein said terminal cluster is welded to said housing and comprises a plurality of terminal pins which extend upwardly and are hermetically sealed.

12. In a hermetic compressor for compressing a fluid, including a metallic housing, an electrical grounding lead, a terminal cluster welded to the metallic housing and comprising a plurality of terminal pins which extend upwardly and are hermetically sealed, a metallic stud connected to the metallic housing and being electrically conductive therewith, and a protective cap member enclosing the terminal cluster, wherein the cap member is held in place by the metallic stud, a grounding device for connecting the electrical grounding lead to the metallic stud, said grounding device comprising:

an electrically conductive L-shaped body;

fastener means for securing said body to the grounding lead, said fastener means including a threaded fastener that is received within a threaded aperture in a first leg of said L-shaped body;

an aperture in a second leg of said L-shaped body; and locking means comprising a plurality of resilient ears in said aperture that resiliently and frictionally engage the metallic stud, said locking means including said ears permitting axial movement of the metallic stud through said aperture in one axial direction only and resisting axial movement of the metallic stud through said aperture in the opposite axial direction.

* * * * *